US005445494A

United States Patent [19]

Hanson

[11] Patent Number: 5,445,494

[45] Date of Patent: Aug. 29, 1995

[54] MULTI-STAGE CENTRIFUGAL PUMP WITH CANNED MAGNETIC BEARING

[75] Inventor: Lloyd D. Hanson, Los Angeles, Calif.

[73] Assignee: BW/IP International, Inc., Long Beach, Calif.

[21] Appl. No.: 148,951

[22] Filed: Nov. 8, 1993

[51] Int. Cl.[6] ..... F01D 3/00

[52] U.S. Cl. ..... 415/107; 415/111; 417/365; 417/423.12

[58] Field of Search ..... 417/365, 423.12; 415/104, 105, 107, 111

[56] References Cited

U.S. PATENT DOCUMENTS

| | | | |
|---|---|---|---|
| 3,718,406 | 2/1973 | Onal . | |
| 4,057,369 | 11/1977 | Isenberg et al. . | |
| 4,579,508 | 4/1986 | Tsumaki et al. . | |
| 4,609,332 | 9/1986 | Miki et al. . | |
| 4,746,265 | 5/1988 | Luijten . | |
| 4,878,813 | 11/1989 | Miki . | |
| 4,929,158 | 5/1990 | Girault . | |
| 4,948,348 | 8/1990 | Doll et al. . | |
| 5,033,936 | 7/1991 | Shinojima . | |
| 5,059,092 | 10/1991 | Kabelitz et al. . | |
| 5,104,284 | 4/1992 | Hustak, Jr. et al. | 415/107 |
| 5,112,202 | 5/1992 | Oshima et al. . | |
| 5,126,610 | 6/1992 | Fremerey . | |
| 5,126,612 | 6/1992 | Girault . | |
| 5,127,792 | 7/1992 | Katsuta et al. . | |
| 5,158,440 | 10/1992 | Cooper et al. . | |
| 5,312,225 | 5/1994 | Lorenzen | 415/105 |
| 5,312,226 | 5/1994 | Miura et al. | 415/107 |
| 5,340,272 | 8/1994 | Fehlau | 415/104 |

FOREIGN PATENT DOCUMENTS

| | | | |
|---|---|---|---|
| 0355796 | 2/1990 | European Pat. Off. . | |
| 858196 | 12/1952 | Germany . | |
| 897048 | 11/1953 | Germany . | |
| 922807 | 1/1955 | Germany . | |
| 3700153 | 7/1987 | Germany | 415/107 |
| 1267392 | 10/1989 | Japan . | |
| 0019694 | 1/1990 | Japan | 417/365 |
| 2130655 | 6/1984 | United Kingdom | 415/107 |

OTHER PUBLICATIONS

International Search Report and Annex.

Pumps, Pompes, Pumpen, No. 172, Jan. 1981, Morden GB, p. 22.

Patent Abstracts of Japan, vol. 14, No. 271, (M-0983) 12 Jun. 1990 and 20 078 793 (EBARA) 19 Mar. 1990.

Nelik et al., "Magnetic Bearings In Boiler Feed Pumps," ROMAG '91 Magnetic Bearing Conference, Mar. 1991, Washington, D.C.

Marscher, et al., "Development Of An Active Magnetic Bearing For a 50 HP Motor PUmp," ROMAG '91 Magnetic Bearing Conference, Mar. 1991, Washington, D.C.

Hanson et al., "Development of a Magnetic Bearing API Process Pump With a Canned Motor," Ninth International Pump User Symposium, Mar. 1992.

*Primary Examiner*—Edward K. Look
*Assistant Examiner*—Mark Sgantzos
*Attorney, Agent, or Firm*—Pretty, Schroeder, Brueggemann & Clark

[57] ABSTRACT

A multistage centrifugal pump for increasing the pressure of a product fluid passing through it. The pump includes a casing, an impeller shaft mounted for rotation within the casing and a plurality of impellers mounted back-to-back on the impeller shaft. A canned magnetic radial bearing is mounted around the outboard end of the impeller shaft and a magnetic thrust bearing and a magnetic radial bearing are mounted around the drive end of the impeller shaft. The pump is free of any product fluid return line connecting the product fluid chambers at the drive and outboard ends of the shaft.

10 Claims, 1 Drawing Sheet

MULTI-STAGE CENTRIFUGAL PUMP WITH CANNED MAGNETIC BEARING

BACKGROUND OF THE INVENTION

This invention relates generally to multi-stage centrifugal pumps, and, more particularly, to axially balanced multi-stage pumps having canned magnetic bearings at their outboard ends.

Axially balanced multi-stage pumps typically include a casing having an inlet port and an outlet port, an impeller shaft supported for rotation within the casing by external oil-lubricated bearings, a seal structure arranged between the casing and the impeller shaft, at each end of the impeller shaft and a plurality of impellers mounted on the impeller shaft. To balance the axial thrust imparted to the impeller shaft by the impellers during operation of the pump, the impellers are typically mounted back-to-back, wherein a first set of the impellers are arranged in a first direction and a second set of the impellers are arranged in a second direction, opposite the first direction.

In multi-stage pumps having the back-to-back impeller arrangement, one end of the pump is typically at a higher pressure than the other end. Consequently, the pump may still be imbalanced because the pressure of the pumped fluid acting on the seal structure at the high pressure end of the pump will be greater than that acting on the other seal structure at the low pressure end. To overcome this seal pressure imbalance, a seal pressure chamber may be provided at the high pressure end of the pump and placed in fluid communication with the low pressure end of the pump via a leakage return line to equalize the pressures at each end of the pump. A fluid flow restrictor may also be placed in the high pressure end to limit fluid leakage to the seal pressure chamber. Further details of this type of axially balanced multi-stage pump are set forth in U.S. Pat. No. 3,718,406 issued to Onal.

The axially balanced multi-stage centrifugal pump described above functions generally satisfactorily to accommodate the axial thrust being generated. However, it is nevertheless subject to drawbacks. In particular, the flow of pumped fluid through the leakage return line represents a significant loss of power and thus lowers pump efficiency. Additionally, the seals and oil lubricated bearings are among the higher maintenance items on the pump, resulting in increased repair costs and decreased overall reliability.

It should therefore be appreciated that there is still a need for a multi-stage centrifugal pump having increased efficiency and reliability and fewer maintenance problems. The present invention satisfies this need.

SUMMARY OF THE INVENTION

The present invention is embodied in a multi-stage centrifugal pump having a canned magnetic bearing at its outboard end. The canned magnetic bearing replaces the seal and the external oil lubricated bearing at the outboard end of the pump and further permits the elimination of the leakage return line used in previous pumps to maintain pump balance. If desired, pump balance may be restored by changing the impeller arrangement and/or modifying some of the impeller wear rings. In any event, pump efficiency and reliability is significantly increased.

More particularly, the multi-stage centrifugal pump of the present invention includes a casing having an inlet port and an outlet port. An impeller shaft is mounted for rotation with the casing. A motor for rotating the shaft is mounted to a drive end of the impeller shaft. A seal structure is mounted between the casing and the impeller shaft at the drive end of the impeller shaft. A plurality of impellers are mounted in a back to back relationship on the impeller shaft between the drive end of the shaft and an outboard end of the shaft. A canned magnetic radial bearing supports the outboard end of the impeller shaft within a bearing chamber of the casing, closing off the outboard end of the casing such that the fluid pressure of the pumped fluid against the seal structure and the fluid pressure of the pumped fluid in the bearing chamber are not equalized.

A feature of the present invention is the elimination of the leakage return line previously used to equalize the seal pressures at each end of the pump. Since a normal sealing device would be incapable of operating reliably under the resultant high pressure at the outboard end of the pump, the outboard end seal structure and external oil lubricated bearing with associated oil pressure system are replaced by a high pressure canned magnetic radial bearing. Removing the leakage return line eliminates the pumping loss associated with that flow. Efficiency may be increased by 1.5% to 3% for a newly manufactured pump and by 3% to 6% at the normally recommended refurbishment point for pumps already in service. Replacing the outboard end seal structure and external oil lubricated bearing also eliminates two high maintenance items on the pump.

A further feature of the present invention is a drive end magnetic thrust bearing that is located outside the pump casing and preferably exposed to the atmosphere. Isolating the magnetic thrust bearing from the pumped fluid reduces friction losses and therefore further increases efficiency. An advantage of the magnetic bearings used in the present invention is that they provide diagnostic output of vibration and changing bearing loads that can improve pump operation and maintenance.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWING

The FIGURE is a cross-sectional view of a multi-stage centrifugal pump according to the present invention, taken along the axis of the pump's impeller assembly.

DETAILED DESCRIPTION OF THE PREFERRED EMBODIMENT

Figure 1:
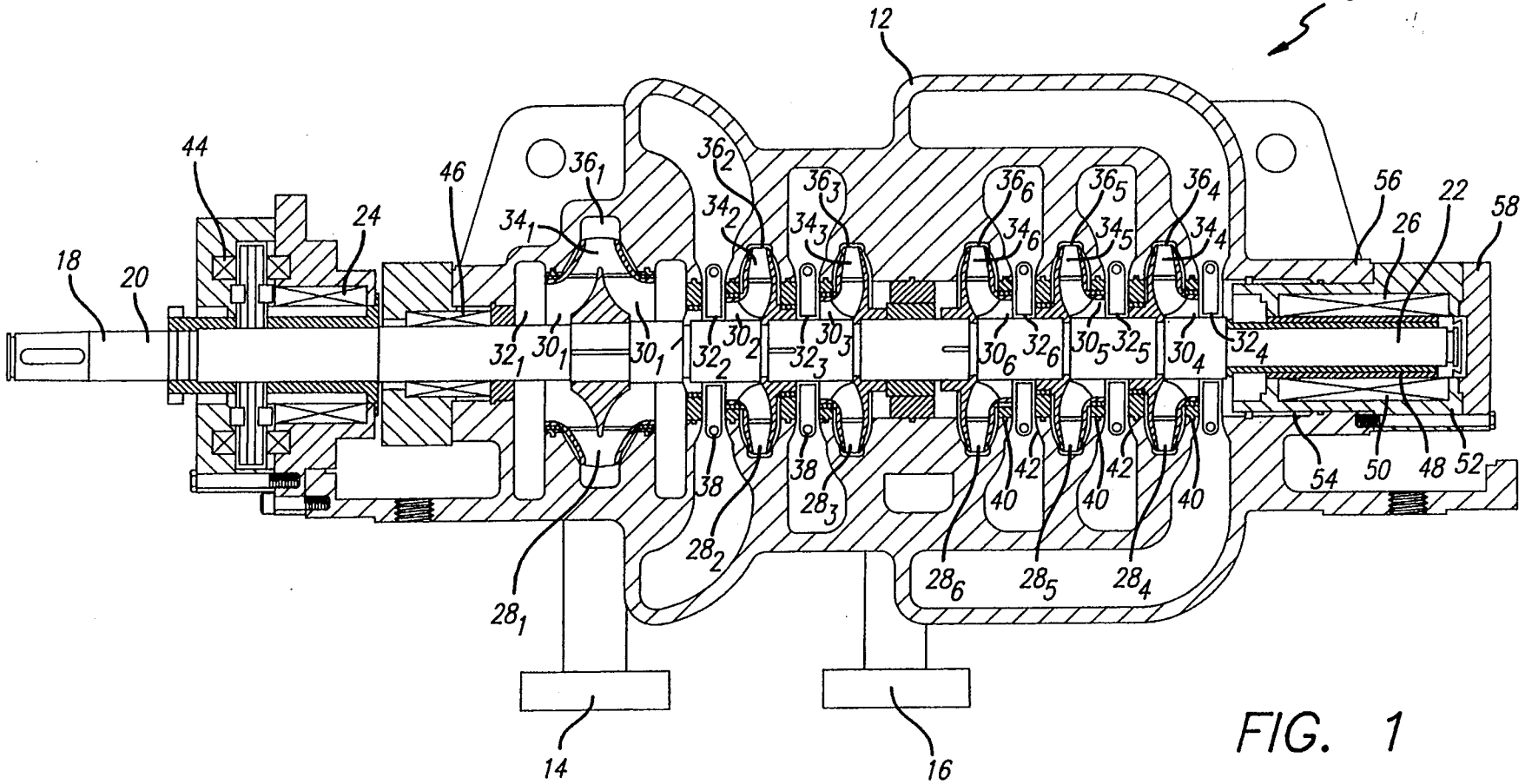

A multi-stage centrifugal pump 10 embodying the features of the present invention is shown in the FIGURE. Such a pump may be used, among other things, as a boiler feed pump or refinery charge pump. The pump includes an outer casing 12 having a pumpage inlet port 14 and outlet port 16. An impeller shaft 18 is mounted for rotation within the casing. The impeller shaft includes a drive end 20 rotatably driven by a suitable drive means such as a motor (not shown) and an outboard end 22 opposite the drive end. The drive end and outward end of the impeller shaft are equipped with magnetic radial bearings 24, 26 respectively, which rotatably support the shaft within the casing.

A plurality of impellers $28_1$–$28_6$ are mounted along the axis of the impeller shaft within the casing in a back-to-back arrangement. The impellers are tightly fitted onto the impeller shaft and connected to the shaft by means of suitable keys and retainer rings (not shown). Each impeller 28 includes a suction inlet 30 for receiving the pumped fluid or pumpage from a suction chamber 32 encircling the shaft 18 and a discharge outlet 34 for discharging the pumpage radially outwardly into a discharge chamber 36. Subscript numerals 1 through 6 are used to identify the particular impeller stage with which a specifically identified suction inlet, suction chamber, discharge outlet or discharge chamber is associated.

Each impeller rotates within an annular chamber sized to accommodate the impeller and to define the discharge chamber adjacent its periphery. The suction inlet 30 of each impeller 28 encircles the impeller shaft 18 and is oriented to receive the pumpage generally axially along the shaft from the associated suction chamber 32. Baffles 38 located in each suction chamber prevent a circumferential motion of the pumpage entering the suction inlet 30 of the adjacent impeller 28. The discharge outlet 34 of each impeller is located at the impeller's outer periphery, and it is oriented to direct the pumpage radially outwardly into the encircling discharge chamber 36.

Passageways (now shown) are defined in the casing 12 to direct the pumpage from each discharge chamber 36 to the next succeeding suction chamber 32. In particular, a first passageway channels the pumpage from the first discharge chamber $36_1$ to the second suction chamber $32_2$, a second passageway channels the pumpage from the second discharge chamber $36_2$ to the third suction chamber $32_3$, a third crossover passageway channels the pumpage from the third discharge chamber $36_3$ to the fourth suction chamber $32_4$, and so on. Additional passageways (not shown) are defined in the casing to connect the inlet port 14 with the first suction chamber $32_1$ and the outlet port 16 with the last discharge chamber $36_6$. In the special case of the first-stage impeller $28_1$, it includes a second suction inlet $30_1'$ oriented in opposed relationship to the first suction inlet $30_1$. This facilitates the flow of pumpage into the pump 10 via the inlet port 14.

Two types of wear rings 40 and 42 are mounted in the casing 12, encircling the throat and hub, respectively, of each impeller 28. Each throat ring 40 isolates the suction chamber 32 from the discharge chamber 36 of a particular impeller, while each hub ring 42 isolates the discharge chamber of that impeller from the suction chamber 32 of the next succeeding impeller. Complementary grooves (not shown) can be formed in the facing surfaces of the wear rings and their associated impeller throats and hubs of the impellers, to create fluid flow restriction labyrinths that limit fluid leakage to a selected and acceptable rate.

During operation of the pump, each impeller 28 imparts a substantially axial force or thrust to the impeller shaft 18. This axial force arises because one entire side of each impeller is exposed to pumpage at a relatively high pressure, while only a part of the other side of that impeller is exposed to that same pressure with the remaining part of the other side of that impeller being exposed to pumpage at a comparatively lower pressure.

The axial thrust imparted to the impeller shaft 18 by the impellets 28 is partly balanced by sequencing and orienting the impellers in a back-to-back arrangement such that a first set of the impellers $28_1$, $28_2$, $28_3$ imparts an axial thrust in one direction (i.e., to the left) while a second set of the impellers $28_4$, $28_5$, $28_6$ imparts an axial thrust in the opposition direction (i.e., to the right).

The outside diameters of the hub and throat of each impeller and the inside diameters of the wear rings 40, 42 may also be adjusted so that the pressure differential associated with each impeller is appropriately selected.

A magnetic thrust bearing 44 is mounted to the drive end of the shaft to take up any residual thrust imbalance of the pump caused by momentum effects, tolerances, flow effects, etc. In the preferred embodiment, the magnetic thrust bearing 44 and the drive end magnetic radial bearing 24 are disposed outside the casing and therefore are not exposed to pumped fluid. Isolating the magnetic thrust bearing from the fluid being pumped reduces friction losses and therefore increases efficiency. A seal structure 46, such as a lapped face mechanical seal, a labyrinth seal, a packed gland, etc. may be used to seal the drive end of the shaft, separating the pumped fluid in the first suction chamber $32_1$ from the drive end magnetic radial bearing and the magnetic thrust bearing.

The outboard end magnetic bearing 26 is preferably a high pressure active canned radial magnetic bearing of a construction well known to those skilled in the art. The canned magnetic bearing is enclosed within the casing and is exposed to the pumped fluid. It should be appreciated that the outboard end of the shaft is closed off by the canned magnetic radial bearing and does not require a seal structure. Additionally, because the outboard end is closed off, the magnetic thrust bearing, which is preferably exposed to the atmosphere, is located at the drive end of the shaft.

Typically, the canned magnetic bearing has a rotor 48 that consists of electrical steel laminations shrunk onto stainless steel carriers. End plates and stainless steel cans (not shown) are welded around the laminations to form a sealed assembly. The rotor is then fastened to the impeller shaft 18. Similarly, stator laminations and coils 50 are mounted to a bearing housing 52 and sealed using end plates and welded stainless steel cans on the inside diameter. The bearing housing is then mounted within a bearing chamber 54 of the outer casing 12 of the pump. An outboard end 56 of the casing may be closed off and sealed by an end plate 58.

The canned magnetic bearing replaces the outboard end seal structure and external oil lubricated bearings of previous multi-stage centrifugal pumps. To improve efficiency, the leakage return line and fluid flow restrictor of previous multi-stage pumps are also eliminated.

A pump imbalance arises because the pumped fluid pressure at the outboard end of the impeller shaft, i.e. the fluid pressure in suction chamber $32_4$, will be much higher than the pumped fluid pressure acting on the seal structure at the drive end of the pump, i.e. the fluid pressure in suction chamber $32_1$. Pump balance may be restored, however, by modifying some of the impeller wear rings, particularly the wear rings 40, 42 associated with impellers $28_4$, $28_5$, $28_6$. Alternatively, for newly constructed pumps, the order and orientation of the impellers may be appropriately adjusted, for example, two impellers may be oriented in one direction and four impellers oriented in the opposite direction.

It should be appreciated from the foregoing description that the present invention provides an improved multi-stage centrifugal pump that improves efficiency and eliminates a number of high maintenance components. Additional value is achieved because the bearing control system of the magnetic bearings provides diagnostic output of vibration and changing bearing loads that can improve pump operation and maintenance.

Although the invention has been described in detail with reference only to the preferred embodiment, those having ordinary skill in the art will appreciate that various modifications can be made without departing from the invention. Accordingly, the invention is defined with reference to the following claims.

I claim:

1. A multistage centrifugal pump for pumping a fluid, comprising:

a casing having a first end and a second end and defining an interior bore, an inlet port for providing the pumped fluid into the bore, an outlet port for discharging the pumped fluid from the bore, and a bearing chamber at the second end of the casing;

a rotatable impeller shaft having a drive end at the first end of the casing and an outboard end located in the bearing chamber at the second end of the casing;

a plurality of impellers mounted on the impeller shaft between the drive end and the outboard end of the impeller shaft, a first set of at least one of the plurality of impellers oriented to direct the pumped fluid generally in a first direction and a second set of at least another one of the plurality of impellets oriented to direct the pumped fluid generally in a second, opposite direction;

a seal mounted between the casing and the impeller shaft at the drive end of the impeller shaft;

a bearing mounted around the drive end of the impeller shaft, rotatably supporting the drive end of the impeller shaft; and a canned magnetic radial bearing mounted around the outboard end of the impeller shaft within the bearing chamber of the casing, rotatably supporting the outboard end of the impeller shaft;

wherein the bearing chamber is pressurized with pumped fluid during operation of the pump.

2. The multistage centrifugal pump of claim 1, wherein the first end of the casing defines a first chamber for receiving pumped fluid between the seal and the impeller nearest the drive end of the impeller shaft, and wherein the pump in operation contains lower pressure pumped fluid in the first chamber at the first end of the casing and higher pressure pumped fluid in the bearing chamber at the second end of the casing.

3. The multistage centrifugal pump of claim 1, further comprising a magnetic thrust bearing mounted at the drive end of the impeller shaft to take up thrust imbalance imparted to the impeller shaft.

4. The multistage centrifugal pump of claim 3, wherein the seal is located between the impeller nearest the drive end of the impeller shaft and the magnetic thrust bearing.

5. The multistage centrifugal pump of claim 4, wherein the bearing mounted around the drive end of the impeller shaft is a magnetic radial bearing, and wherein the seal is located between the impeller nearest the drive end of the impeller shaft and the magnetic radial bearing.

6. The multistage centrifugal pump of claim 3, wherein the magnetic thrust bearing is isolated from the pumped fluid.

7. The multistage centrifugal pump of claim 1, wherein the second end of the casing defines a second chamber for receiving pumped fluid between the bearing chamber and the impeller nearest the outboard end of the impeller shaft, and wherein the pump has no leakage return line that permits leakage of pumped fluid from the second chamber to the first chamber.

8. A multistage centrifugal pump for pumping a fluid, comprising:

a casing having a first end and a second end and defining an interior bore, an inlet port for providing the pumped fluid into the bore, an outlet port for discharging the pumped fluid from the bore, and a bearing chamber at the second end of the casing;

a rotatable impeller shaft having a drive end at the first end of the casing and an outboard end located in the bearing chamber at the second end of the casing;

a plurality of impellers mounted on the impeller shaft between the drive end and the outboard end of the impeller shaft, a first set of at least one of the plurality of impellers oriented to direct the pumped fluid generally in a first direction and a second set of at least another one of the plurality of impellers oriented to direct the pumped fluid generally in a second, opposite direction;

a seal mounted between the casing and the impeller shaft at the drive end of the impeller shaft;

a bearing mounted around the drive end of the impeller shaft, rotatably supporting the drive end of the impeller shaft; and a canned magnetic radial bearing mounted around the outboard end of the impeller shaft within the bearing chamber of the casing, rotatably supporting the outboard end of the impeller shaft;

wherein the first end of the casing defines a first chamber for receiving pumped fluid between the seal and the impeller nearest the drive end of the impeller shaft, and wherein the pump in operation contains lower pressure pumped fluid in the first chamber at the first end of the casing and higher pressure pumped fluid in the bearing chamber at the second end of the casing.

9. The multistage centrifugal pump of claim 8, further comprising a magnetic thrust bearing mounted at the drive end of the impeller shaft to take up thrust imbalance imparted to the impeller shaft;

wherein the canned magnetic thrust bearing and the bearing mounted around the drive end of the impeller shaft are isolated from the pumped fluid;

and wherein the second end of the casing defines a second chamber for receiving pumped fluid between the bearing chamber and the impeller nearest the outboard end of the impeller shaft, and wherein the pump has no leakage return line that permits leakage of pumped fluid from the second chamber to the first chamber.

10. A multistage centrifugal pump for pumping a fluid, comprising:

a casing having a first end and a second end and defining an interior bore, an inlet port for providing the pumped fluid into the bore, an outlet port for discharging the pumped fluid from the bore, and a bearing chamber at the second end of the casing;

a rotatable impeller shaft having a drive end at the first end of the casing and an outboard end located in the bearing chamber at the second end of the casing;

a plurality of impellers mounted on the impeller shaft between the drive end and the outboard end of the impeller shaft, a first set of at least one of the plurality of impellers oriented to direct the pumped fluid generally in a first direction and a second set of at least another one of the plurality of impellets oriented to direct the pumped fluid generally in a second, opposite direction;

a seal mounted between the casing and the impeller shaft at the drive end of the impeller shaft;

a magnetic radial bearing mounted around the drive end of the impeller shaft, rotatably supporting the drive end of the impeller shaft;

a canned magnetic radial bearing mounted around the outboard end of the impeller shaft within the bearing chamber of the casing rotatably supporting the outboard end of the impeller shaft; and a magnetic thrust bearing mounted at the drive end of the impeller shaft to take up thrust imbalance imparted to the impeller shaft;

wherein the first end of the casing defines a first chamber for receiving pumped fluid between the seal and the impeller nearest the drive end of the impeller shaft, and wherein the pump in operation contains lower pressure pumped fluid in the first chamber at the first end of the casing and higher pressure pumped fluid in the bearing chamber at the second end of the casing;

and wherein the magnetic thrust bearing and the magnetic radial bearing around the drive end of the impeller shaft are mounted outside the casing.

* * * * *